United States Patent [19]

Minemura et al.

[11] 4,445,903

[45] May 1, 1984

[54] PROCESS FOR THE PREPARATION OF WOVEN FABRICS OF LOW AIR PERMEABILITY

[75] Inventors: Norihiro Minemura, Takatsuki; Shigenobu Kobayashi, Toyonaka, both of Japan

[73] Assignee: Teijin Limited, Osaka, Japan

[21] Appl. No.: 488,855

[22] Filed: Apr. 26, 1983

[30] Foreign Application Priority Data

| | | | |
|---|---|---|---|
| Apr. 26, 1982 | [JP] | Japan | 57-68764 |
| Aug. 12, 1982 | [JP] | Japan | 57-139122 |
| Aug. 13, 1982 | [JP] | Japan | 57-139689 |
| Feb. 14, 1983 | [JP] | Japan | 58-21618 |

[51] Int. Cl.[3] ..... D06P 7/00; D06P 1/651; D06M 7/02

[52] U.S. Cl. ..... 8/492; 8/491; 8/495; 8/496; 8/130.1

[58] Field of Search ..... 8/491, 492, 495, 496, 8/130.1

[56] References Cited

U.S. PATENT DOCUMENTS

| | | | |
|---|---|---|---|
| 3,953,167 | 4/1976 | Minemura et al. | 8/491 |

FOREIGN PATENT DOCUMENTS

| | | | |
|---|---|---|---|
| 54-138689 | 10/1979 | Japan | 8/130.1 |
| 54-138690 | 10/1979 | Japan | 8/130.1 |
| 55-71870 | 5/1980 | Japan | 8/130.1 |
| 55-84485 | 6/1980 | Japan | 8/492 |

*Primary Examiner*—Maria Parrish Tungol

*Attorney, Agent, or Firm*—Sughrue, Mion, Zinn, MacPeak & Seas

[57] ABSTRACT

A process for the preparation of a woven fabric of low air permeability which comprises preparing a woven fabric by use of a composite fiber of a splitting and severing type, which consists of polyester and polyamide and produces extremely fine fibers of 0.001 to 0.8 denier size, as a warp and/or a weft; treating thus obtained woven fabric by use of an aqueous emulsion of a swelling agent for polyester and nylon under the conditions where nylon is mainly allowed to swell and then shrink; scouring and dyeing the woven fabric; and after calendering the woven fabric with the use of heated rollers rotated under pressure.

5 Claims, 1 Drawing Figure

PROCESS FOR THE PREPARATION OF WOVEN FABRICS OF LOW AIR PERMEABILITY

BACKGROUND OF THE INVENTION

The present invention relates to a process for the preparation of a woven fabric of low air permeability having a fine texture of excellent feeling which comprises extra fine fibers.

Processes for preparing a woven or knitted fabric of low air permeability having a fine and dense texture made from extra fine fibers are now publicly known. For example, Japanese Patent Application Laying-Open No. 63071/81 discloses a method which comprises preparing a woven or knitted fabric of fine texture from composite fibers of an islands-in-sea type, followed by treatments of removing the sea component and also making the fibers water and oil repellent. However, in case where composite fibers of an islands-in-sea type are used, a woven fabric of sufficiently low air permeability is not always obtained because of the decrease in the total cross-sectional area of the filaments as a unit resulting from the removal of the sea component from the composit fiber. Also, Japanese Patent Application Laying-Open No. 154546/81 discloses a method for preparing a highly dense knitted fabric by use of a composite fiber of a fibrilliform type comprising polyamide and polyester having a single fibrillose filament size of 0.5 denier or less after the fibrillation of the composite fiber. However, it does not necessarily follow that this method is an easy one from an industrial viewpoint since the method includes the use of benzyl alcohol of high concentration (30%) as an agent for the fibrillation of the composite fiber and also the steam treatment at 65° to 100° C. for the fibrillation.

SUMMARY OF THE INVENTION

It is an object of this invention to produce a woven fabric of low air permeability with the industrially easy processes by use of a composite fiber of a splitting and severing type.

The object of the present invention can be achieved by the process for the preparation of a woven fabric of low air permeability which comprises preparing a woven fabric by use of a composite fiber of a splitting and severing type, which consists of polyester and polyamide and produces extremely fine fibers of 0.001 to 0.8 denier size, as a warp and/or a weft; treating thus obtained woven fabric by use of an aqueous emulsion of a swelling agent for polyester and nylon under the conditions where nylon is mainly allowed to swell and then shrink; scouring and dyeing the woven fabric; and after calendering the woven fabric with the use of heated rollers rotated under pressure.

DESCRIPTION OF THE PREFERRED EMBODIMENT

Figure 1:
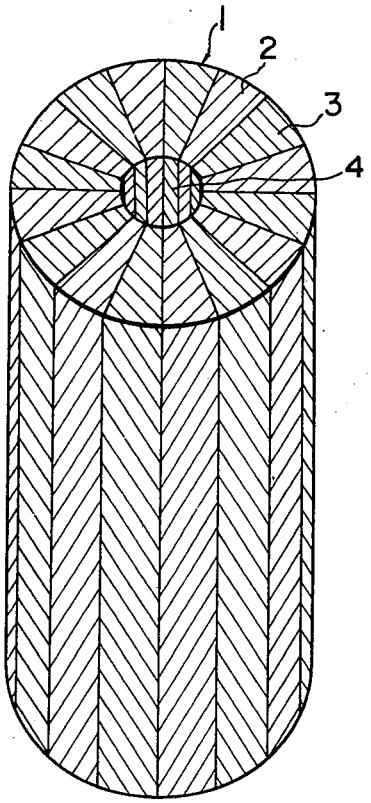
FIG. 1 is an isometric sectioned view showing a type specimen of a composite fiber of a splitting and severing type used in this invention.

As the composite fiber of a splitting and severing type, which produces extra fine fibers of 0.01 to 0.8 denier, to be used in the present invention, any of the publicly known composite fibers of a similar type can be used. For example, a hollow composite fiber, which consists of polyester components and polyamide components, at least four of them being alternately put together side by side in a circular arrangement, all components extending along the longitudinal axis of the fiber to form a tubular structure as a whole, disclosed by Japanese Patent Application Laying-Open No. 70366/76 and these composite fibers of a splitting and severing type disclosed by U.S. Pat. No. 3117362 and Japanese Patent Application Laying-Open No. 58578/76 may be mentioned. In case where extra fine fibers are less than 0.001 denier in size, they are not of practical use in view of their physical properties such as fiber strength, etc. and where these fibers are more than 0.8 denier in size, they have not enough water-resisting qualities to meet the object of the present invention, thus both being inapplicable.

In the present invention, a woven fabric is first prepared using the aforementioned composite fiber of a splitting and severing type as a warp and/or a weft. As for the construction of the woven fabric, the plain weave is desirable and the weave density should preferably be 120 warps/inch or more and 70 wefts/inch or more. Especially desirable one is the plain weave obtained by use of a composite filament of a splitting and severing type as a weft and polyester or nylon filament as a warp having the weave density of about 120 to 180 warps/inch and 70 to 120 wefts/inch.

The woven fabric thus obtained is treated by use of an aqueous emulsion of a swelling agent for polyester and nylon under the conditions where nylon is mainly allowed to swell and then shrink. As the swelling agent, phenylphenols, chlorobenzenes, naphthalene, diphenyls, phenol, cresol, benzyl alcohol, phenylethyl alcohol, tolyl alcohol, etc. may be mentioned. The most desirable ones are phenylphenols expressed by the following general formula (I)

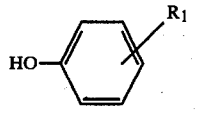

(I)

wherein $R_1$ indicates a phenyl group or a lower alkyl substituted phenyl group. Also, chlorobenzenes expressed by the following general formula (II), naphthalenes expressed by formula (III), and diphenyls expressed by formula (IV) are desirable ones.

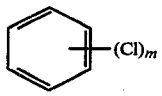

(II)

wherein m is an integer 1 to 3,

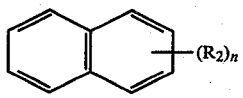

(III)

wherein $R_2$ is hydrogen or an alkyl group having 1 to 4 carbon atoms; n is an integer 1 to 2,

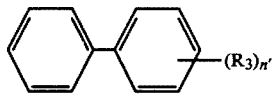

(IV)

wherein $R_3$ is hydrogen or an alkyl group having 1 to 4 carbon atoms; n' is an integer 1 to 2.

In the present invention, the aforementioned woven fabric is treated with an aqueous emulsion of 0.1 to 5% by weight phenylphenols expressed by the aforementioned general formula (I), for instance, at a temperature of 40° C. or below prior to its ordinary scouring and dyeing. As the concrete examples of phenylphenols expressed by general formula (I), o-phenylphenol, m-phenylphenol, p-phenylphenol, for instance, may be mentioned. Phenylphenols can be made into an aqueous emulsion by use of an appropriate surface active agent which is commercially available. In the present invention, an aqueous emulsion of phenylphenol is used with its concentration adjusted to contain 0.1 to 5% by weight, desirably 0.2 to 2.0% by weight, of pure phenylphenol. The treatment of the woven fabric with such an aqueous emulasion is to be conducted at a temperature of 40° C. or below, preferably at 10° to 35° C. It is known that phenylphenols used in this invention have a function to shrink polyester fibers and polyamide fibers in general. However, when the treatment is carried out at the concentration and the temperature adjusted to the aforementioned ranges, the shrinkage of polyester is very slight while the shrinkage of nylon is very large and this makes the difference in the degree of shrinkage between the two polymers very large. Therefore, when the composite fiber of a splitting and severing type consisting of polyester components and polyamide components is treated under such conditions, a great interface strain resulting from the difference in the degree of shrinkage between the two different components is imposed on the respective components and the composite fiber starts in parts to split and sever into extra fine fibers of respective components. At the same time, the composite fiber is brought into a state of high strain under which it tends to be readily split and severed by a mechanical or thermal action in the following scouring and dyeing processes. The method of treatment includes one under which a woven fabric is immersed in an aqueous emulsion of phenylphenol at the prescribed temperature for a fixed period of time and another under which a woven fabric is soaked with an aqueous emulsion and treated at the prescribed temperature for a certain time. The former method involves the use of aqueous emulsion five times or more of the woven fabric by weight and the latter method involves the use of aqueous emulsion 70% or more of the woven fabric to have it soaked with. The time for treatment to obtain a good result is 1 to 60 minutes.

As the concrete examples of chlorobenzenes expressed by the aforementioned general formula (II), there are monochlorobenzene, dichlorobenzene, and trichlorobenzene and as examples of naphthalenes expressed by general formula (III), there are α-methylnaphthalene, β-methylnaphthalene, 1,2-dimethylnaphthalene, and 1,4-dimethylnaphthalene, and as examples of diphenyls expressed by general formula (IV), diphenyl may be mentioned. These compounds are used under the conditions similar to those adopted for phenylphenols, wherein the temperature of treatment is 60° C. or below, desirably in the range of 30° to 50° C.

In the present invention, the composite fiber of a splitting and severing type consisting of polyester and polyamide may be submitted to the wet heat treatment at 50° C. or higher, desirably 70° C. or higher, before it is subjected to the aforementioned splitting and severing treatment by use of a swelling agent. The object of the wet heat treatment lies in effecting the partial splitting and severing of the composite fiber, though not to completion, reducing the stiffness of the woven fabric by the partial formation of extra fine fibers, and preventing the development of creases which occurs in the succeeding splitting and severing process. At the time of wet heat treatment, desizing of the woven fabric may be conducted simultaneously by use of a scouring agent or the like. The desizing makes the woven fabric much softer and this is more effective in preventing the creases from developing during the splitting and severing process that follows. No limit is placed upon the method and equipment of wet heat treatment and any known method and equipment are applicable to this treatment. The effect similar to the above treatment can be obtained by press heating the woven fabric by calendering prior to the treatment by use of a swelling agent.

The woven fabric of the present invention is then scoured and dyed according to the ordinary methods. During these scouring and dyeing processes, the composite fiber of a splitting and severing type is completely split and severed to form extra fine polyester and polyamide fibers having a size of 0.001 to 0.8 denier. The woven fabric is then calendered while it is made to pass between the heated rollers under pressure. It is desirable to keep the temperature of the heated rollers at 130° to 180° C. and the pressure at 10 to 80 kg/cm$^2$. In the calendering process, it is advisable to adjust the running speed of the fabric to approximately 5 to 20 m/min. Through this process, the composite fiber is thoroughly split and severed into extra fine fibers and the woven fabric is shrunk and at the same time its surface is smoothed out to the flatness, thus giving the woven fabric a very excellent low air permeability.

In the present invention, the woven fabric may be subjected to a water-repellent treatment with the use of a water repellant before or after the calendering process. As the water repellants, there are water repellants of fluorine type such as perfluoroalkylacrylate, etc. and water repellants of silicone type, of which water repellants of fluorine type are especially desirable. The appropriate amount of application in terms of a solid matter is about 0.1 to 5% by weight of the woven fabric.

In the present invention, the abovementioned woven fabric thus calendered may further have its top or reverse surface coated with polyacrylate, polymethacrylate, polyurethane, natural or synthetic rubber latex, vinyl chloride, vinyl acetate, etc. so that the woven fabric may be made highly water proof. These resins are applied on the basis of about 1 to 10 g/m$^2$, desirably 2 to 5 g/m$^2$, according to the ordinary method of coating. Or the woven fabric may be made water proof by laminating a porous polyethylene film, etc. thereto.

In the present invention, since the woven fabric is made to have an extraordinarily fine and tight construction by subjecting the woven fabric prepared from a composite fiber of a slitting and severing type to the splitting and severing treatment, the resulting woven fabric has a very low air permeability of about 0.5 cc/cm$^2$.sec or less in general and produces a soft and pleasing touch in terms of sensation to the hand or feel of the fabric. Also a woven fabric having a water pressure resistance of about 700 mm and water vapor transmission ratio of 6000 g/m$^2$.24 hr or more even when it is not subjected to or is lightly subjected to water repellent treatment. When such a woven fabric like this is coated with a small amount, for instance, of about 1 to 10 g/m$^2$ of a resin, the coating enhances the fineness and tightness of the construction of the woven fabric to increase its water pressure resistance to 1500 mm or more and decrease its water vapor transmission ratio to 4000 g/m$^2$.24 hr or more, thus giving a woven fabric having an outstanding water proofing property and water vapor permeability. Since a woven fabric prepared according to the present invention has a very fine and tight construction, the coating effect can be achieved with a small amount of resin and the use of such a small amount of resin allows the woven fabric to have enough water vapor permeability even if the coating is not made microporous and also makes the woven fabric soft.

Accordingly, a woven fabric of the present invention which has these characteristic properties can be used widely in making windbreakers, coats, sports pants, quilting wears, down jackets, etc. and also in making umbrellas, tents, bags, and various kinds of covers besides materials for making outer garments.

The following Examples, in which parts and percents are by weight unless otherwise stated, illustrate the invention in detail.

Also in the Examples, the air permeability is determined by JIS L 1096-1979, water pressure resistance by JIS L 1092A (low water pressure method), water repellency by JIS L 1096-1979, and water vapor transmission ratio by JIS Z 0208.

EXAMPLE 1

(1) Preparation of a woven fabric

A hollow composite fiber was prepared according to the method disclosed in Japanese Patent Application Laying-Open No. 70366/76 by use of polyethylene terephthalate having the intrinsic viscosity of 0.62 (determined in orthochlorophenol at 35° C.) and poly-ε-caproamide having the intrinsic viscosity of 1.30 (determined in methacresol at 35° C.), wherein a total of sixteen polyester components and polyamide components were alternately put together side by side in a cirmular arrangement, all the components extending along the longitudinal axis of the fiber to form a tubular structure as a whole as shown in FIG. 1.

In FIG. 1, the numeral 1 is a hollow composite fiber, 2 is a polyamide (poly-ε-caproamide) component, 3 is a polyester (polyethylene terephthalate) component, and 4 is a hollow part.

In the hollow composite fiber shown in FIG. 1, the weight ratio between a combined total of polyamide components and a combined total of polyester components was 1:1, the size in denier of the respective components was 0.23 denier, and the size in denier of the hollow composite fiber was 3.7 denier. The percentage of the hollow part—a ratio between the volume of the hollow part and the total volume of the whole polyamide components, and hollow part—was 8%.

A plain weave (taffeta weave) having the weave density of 105 warps/inch and 73 wefts/inch was prepared using multifilament yarn (150 denier/40 filaments, untwisted) of the abovementioned hollow composite fiber as a weft and multifilament yarn (75 denier/72 filaments, number of turns of twist 300 T/M) of polyethylene terephthalate as a warp.

(2) Processing of the woven fabric

The woven fabric obtained in the above was subjected to the wet heat treatment in a bath containing 1 g/l of soda ash and 1 g/l of Scourol 400 (manufactured by Kao Atlas K.K.) at 90° C. for 20 minutes with the use of a circular dyeing machine (manufactured by Hisaka Seisakusho). The woven fabric was then treated with rope form in an emulsion of 1% Tetrosin OE-N (manufactured by Yamakawa Yakuhin, containing 36% O-phenylphenol) at 30° C. for 30 minutes (bath ratio 1:30) using a circular dyeing machine.

Thereafter, the woven fabric was scoured in a scouring bath containing 5 g/l of soda ash and 1 g/l of Scourol 400 at 90° C. for 20 minutes. After the woven fabric was heat set at 170° C. for 30 seconds, it was dyed in a water base dye bath which contained 4% Duranol Blue G (C.I. No. 63305, trade name for a disperse dye manufactured by I.C.I.), 0.2 ml/l of acetic acid, and 1 g/l of a dispersing agent mainly consisting of a condensation product of naphthalene sulfonic acid with formaldehyde at 130° C. for 60 minutes. The dyed woven fabric was then subjected to soaping in an aqueous solution containing a nonionic detergent at 80° C. for 20 minutes and was dried at 120° C. for 3 minutes.

After having been dried, the woven fabric was calendered by use of hot rollers at 170° C. under pressure of 20 kg/cm$^2$.

Thus obtained woven fabric was of good quality having no crease in the rope form. And the obtained woven fabric had the weave density of 145 warps/inch and 85 wefts/inch, and its air permeability was 0.4 cc/cm$^2$.sec (in contrast to an ordinary taffeta weave which has the air permeability of about 2 to 10 cc/cm$^2$.sec).

EXAMPLE 2

The woven fabric obtained in Example, (1), was processed according to the same procedures as Example 1, except that, prior to the calendering, the woven fabric was immersed in a solution of 6% Asahi Buard AG-730 (a water and oil repellant of fluorine type manufactured by Asahi Glass), squeezed to a pickup of 100%, dried at 120° C. for 1 minute, and heat set at 160° C. for 30 seconds. After that, the woven fabric was calendered according to Example 1.

The woven fabric thus obtained had the air permeability of 0.4 cc/cm$^2$.sec, water pressure resistance of 850 mm, and the water repellency percentage of 100.

EXAMPLE 3

The woven fabric obtained in Example 1, (1), was calendered at 80° C. under pressure of 20 kg/cm$^2$ and then immersed in an emulsion of 1% Tetrosin OE-N (manufactured by Yamakawa Yakuhin, containing 35% O-phenylphenol) at 30° C. for 30 minutes (bath ratio 1:30). Thereafter, the woven fabric was scoured and dyed according to Example 1.

Next, the woven fabric was immersed in a solution of 6% Asahi Guard AG-730 (a water and oil repellant of fluorine type manufactured by Asahi Glass), squeezed to a pickup of 100%, dried at 120° C. for 1 minute, and heat set at 160° C. for 30 seconds.

After that, the woven fabric was calendered with hot rollers at 170° C. under pressure of 20 kg/cm$^2$.

Thus obtained woven fabric had the weave density of 145 warps/inch and 85 wefts/inch, the air permeability of 0.23 cc/cm$^2$.sec., water repellency percentage of 100, water pressure resistance of 700 mm, and water vapor transmission ratio of 7200 g/m$^2$.24 hr.

EXAMPLE 4

The surface reverse to the calendered surface of the woven fabric obtained in Example 3 was coated with a solution of polyurethane having the following components according to the floating knife coating method.

| | |
|---|---|
| Crisbon 2016E (manufactured by Dai Nippon Ink & Chemical Inc.) (one liquid type polyurethane, 30% purity) | 100 parts |
| Crisbon No. 5 (manufactured by Dai Nippon Ink & Chemical Inc.) (anti-blocking agent) | 5 parts |
| Crisbon NX (manufactured by Dai Nippon Ink & Chemical Inc.) (modified polyisocyanate, cross linking agent) | 3 parts |
| Methyl ethyl ketone | 10 parts |

After the coating was over, the coated woven fabric was dried at 80° C. for 30 seconds and further at 100° C. for 30 seconds and heat set at 160° C. for 1 minute.

The physical properties of thus obtained woven fabric were as follows:

| |
|---|
| Amount of coating: 3.5 g/m$^2$ |
| Weave density: 145 warps/inch, 85 wefts/inch |
| Air permeability: 0.28 cc/cm$^2$ · sec |
| Water pressure resistance: 1500 mm or more |
| Water vapor transmission ratio: 6150 g/m$^2$ · 24 hr |
| Water repellency percentage: 100 |

The obtained woven fabric had a very soft touch to hand when compared to conventional water proof and water vapor permeable woven fabrics and also had an excellent drapability. Also it had an outstanding durability.

EXAMPLE 5

The surface reverse to the calendered surface of the woven fabric obtained according to Example 1, (1) and (2), was coated with a solution of acrylic resin having the following components according to the floating knife coating method.

| | |
|---|---|
| Criscoat P1018 (manufactured by Dai Nippon Ink & Chemical Inc.) (polyacrylate, 20% purity) | 100 parts |
| Crisbon NX (manufactured by Dai Nippon Ink & Chemical Inc.) (modified polyisocyanate, cross linking agent) | 2 parts |
| Ethyl acetate | 15 parts |
| Viscosity | 18000 cps |

After the coating was over, the coated woven fabric was processed according to Example 1.

The physical properties of the obtained woven fabric were as follows:

| |
|---|
| Amount of coating: 3.3 g/m$^2$ |
| Weave density: 145 warps/inch, 85 wefts/inch |
| Air permeability: 0.33 cc/cm$^2$ · sec |
| Water pressure resistance: 1500 mm or more |
| Water vapor transmission ratio: 6200 g/m$^2$ · 24 hr |

-continued

| |
|---|
| Water repellency percentage: 100 |

The obtained woven fabric had a very soft touch to hand and its properties and functions were highly durable.

EXAMPLE 6

The woven fabric obtained in Example 1, (1), was immersed in an emulsion of 1% Teril Carrier C-11 (manufactured by Meisei Chemicals, containing 70% trichlorobenzene and dichlorobenzene) at 40° C. for 30 minutes (bath ratio 1:30).

Thereafter, the woven fabric was scoured, dyed, and calendered according to Example 1.

The obtained woven fabric had the weave density of 145 warps/inch and 85 wefts/inch and air permeability of 0.3 cc/cm$^2$.sec (in contrast to ordinary taffeta weaves which have the air permeability of 2 to 10 cc/cm$^2$.sec).

EXAMPLE 7

In Example 6, prior to the calendering of the woven fabric, the fabric was immersed in a solution of 6% Asahi Guard AG-730 (a water and oil repellant of fluorine type manufactured by Asahi Glass), squeezed to a pickup of 100%, dried at 120° C. for 1 minute, and heat set at 160° C. for 30 seconds. Thereafter, the woven fabric was calendered according to Example 1.

The woven fabric thus obtained had the air permeability of 0.35 c.c./cm$^2$.sec, water pressure resistance of 700 mm, and water repellancy percentage of 100.

EXAMPLE 8

The woven fabric obtained in Example 1, (1), was immersed in an emulsion of 1% Poliescar DS (manufactured by Soryu Dyestuff, containing 55% methylnaphthalene, 10% diphenyl, and 15% trichlorobenzene) at 40° C. for 60 minutes (bath ratio 1:30). Thereafter, the woven fabric was processed and finished according to Example 7 and it was found that the woven fabric had the following physical properties.

| |
|---|
| Finished density: 145 warps/inch, 85 wefts/inch |
| Air permeability: 0.35 c.c./cm$^2$ · sec |
| Water pressure resistance: 700 mm |
| Water repellency percentage: 100 |

The woven fabric also had a very soft touch to hand.

What is claimed is:

1. A process for the preparation of a woven fabric of low air permeability comprising preparing a woven fabric by use of a composite fiber of a splitting and severing type consisting of polyester components and polyamide components, each of which is to be splitted and severed to form an extra fine fiber of 0.001 to 0.8 denier size, as a warp and/or a weft; treating said woven fabric with an aqueous emulsion of a swelling agent for polyester and nylon under the conditions where nylon is mainly allowed to swell and then shrink; scouring and dyeing the woven fabric; and after calendering the woven fabric with the use of heated rollers rotated under pressure.

2. The process for the preparation of a woven fabric of low air permeability according to claim 1, wherein the process involves the treatment of the woven fabric with phenylphenols expressed by the following formula (I) used as a swelling agent for polyester and nylon,

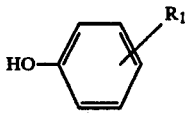

(I)

wherein $R_1$ indicates a phenyl group or a lower alkyl substituted phenyl group, in which the woven fabric is treated in an aqueous emulsion of 0.1 to 5% by weight of said phenylphenol at a temperature of 40° C. or lower.

3. The process for the preparation of a woven fabric of low air permeability according to claim 1, wherein the process involves the treatment of the woven fabric with at least one compound selected from a group consisting of chlorobenzenes expressed by the following formula (II), naphthalenes expressed by formula (III), and diphenyls expressed by formula (IV) used as a swelling agent for polyester and nylon, in which the woven fabric is treated in an aqueous emulsion of 0.1 to 5% by weight of said compound at a temperature of 60° C. or lower:

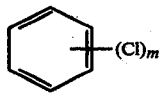

(II)

wherein m is an integer 1 to 3,

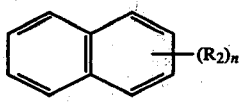

(III)

wherein $R_2$ is hydrogen or an alkyl group having 1 to 4 carbon atoms and n is an integer 1 to 2,

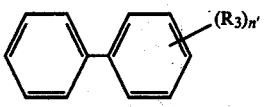

(IV)

wherein $R_3$ is hydrogen or an alkyl group having 1 to 4 carbon atoms and n' is an integer 1 to 2.

4. The process for the preparation of a woven fabric of low air permeability according to claim 1, wherein the process involves a water repellent treatment of the woven fabric after the scouring and dyeing and before or after the calendering of the woven fabric.

5. The process for the preparation of a woven fabric of low air permeability according to claim 1, wherein the process involves a water proof finish treatment of the woven fabric after the calendering.

* * * * *